US005345062A

United States Patent [19]

Maudal

[11] Patent Number: 5,345,062

[45] Date of Patent: Sep. 6, 1994

[54] APPARATUS FOR SUPPORTING ASIAN WOKS ON MODERN KITCHEN RANGES

[76] Inventor: Inge Maudal, 604 Lassen La., Costa Mesa, Calif. 92626

[21] Appl. No.: 966,271

[22] Filed: Oct. 26, 1992

[51] Int. Cl.[5] ..... F23D 11/00

[52] U.S. Cl. ..... 219/432; 219/459; 126/215; 126/214 D

[58] Field of Search ..... 126/214 A, 214 R, 215, 126/39 R, 39 B, 211, 214 D; 219/432, 433, 459

[56] References Cited

U.S. PATENT DOCUMENTS

| | | | |
|---|---|---|---|
| 862,719 | 8/1907 | Davis | 126/215 |
| 1,431,696 | 10/1922 | Shankland | 126/215 |
| 3,198,189 | 8/1965 | Oatley | 126/211 |
| 3,826,897 | 7/1974 | Behr et al. | 219/433 |
| 4,435,638 | 3/1984 | Simon et al. | 219/432 |
| 4,448,186 | 5/1984 | Smith | 126/214 D |
| 4,934,333 | 6/1990 | Ducate et al. | 126/211 |
| 5,158,067 | 10/1992 | Dutro et al. | 126/39 R |

*Primary Examiner*—Carroll Dority

[57] ABSTRACT

A concept for a support stand adapts an Asian WOK to a Western kitchen range. The stand provides an upper ring to receive a round bottomed WOK; the ring has sufficient diameter to accommodate the WOK securely in the stand. The base of the stand adapts to prior art drip pans placed in heating wells, where the well has gas or electrical heating elements located according to the type of range, and thus anchors the stand to the kitchen range top.

A second concept modifies existing drip pans to provide both the functions of drip pan and support stand in a single, combined support stand. This stand replaces existing stands and drip pans and anchors the WOK to the kitchen range top.

A third concept converts a prior WOK fire ring into a trivet allowing use of the WOK at a dinner table.

1 Claim, 7 Drawing Sheets

APPARATUS FOR SUPPORTING ASIAN WOKS ON MODERN KITCHEN RANGES

BACKGROUND OF THE INVENTION

1. Field of the Invention

This invention relates generally to support stands on kitchen ranges and range tops that hold pots and pans over heating elements and more particularly to Asian WOK stands that hold and anchor WOKs and other rounded, deep containers to the range tops.

2. Prior Art

The principal functions of the present invention are to support Asian WOKS and other rounded deep containers over heating elements on kitchen ranges and to anchor these containers over the heating elements.

Kitchen ranges generally have range top surfaces that contain heater wells. These wells facilitate placement of heating elements near or at the range top surfaces and provide means to convey and translate energy forms, such as gas or electricity, into heat. Present kitchen ranges generally use flat support means near or above the wells for supporting cooking utensils. In gas ranges, for example, these devices are generally mounted concentric to a burner. Here they maintain pots and pans at a preferred distance above a gas flame. In this sense they serve and function as spacer means. Electric ranges use heating coils, generally wound in flat spirals, that serve both as heating elements as well as flat support devices. Both types of devices are adapted to support corresponding flat bottomed pots and pans.

The combination of flat bottoms and flat tops allows the pots and pans to slide freely across the range top. There are no anchoring or anchoring means to prevent motion in a horizontal direction. This may be troublesome during vigorous stirring by an uncoordinated chef.

The sideways freedom of motion becomes particularly troublesome when a round-bottomed kettle is placed upon the range top. The oriental WOK, a cooking vessel with a generally spheroid bottom, is one such example. An independent stand is generally provided with the WOK. This is placed loosely on top of a pre-existing flat support stand on top of the range top, and is thus generally centered over a heating element. The entire system, WOK and stand, is free to slide sideways. Furthermore, since the pre-existing support stands are generally higher that the range top surface, and since the special WOK stand is placed on top of the pre-existing support stand, the WOK is generally unstable. It therefore tends to fall off the support as well as slide sideways.

Flat bottomed versions of the WOK, i.e. deep, flat bottomed pans, have been introduced to compensate for the general instability. However, this solution has essentially dispensed with the traditional WOK.

A further function of the present invention is the general support of a round bottom vessel, such as an Asian wok, on a flat surface. The flat surface may be a table top. Because the wok may in general be hot when placed on a table top, there is an obvious need to provide insulation to protect the table top in addition to keeping the vessel upright.

The prior art is replete with examples of devices to protect a table top. Several "hot pads" are made of various insulating cloths. There are also hard surface versions obtaining insulation by utilizing legs. A trivet, originally having three legs, is an example of such a device. However, the word trivet has now become a general term for an insulating device for hot kitchen utensils; legs, in any number, are no longer determinative.

There are no devices in the market place today for insulating support of round bottom vessels.

SUMMARY OF THE INVENTION

A principal feature of this invention is to anchor rounded, deep vessels to a range top. Such anchoring or anchoring means provides seating that prevents sideways sliding. A further feature of this invention is to provide a stand for rounded, deep pots and pans. An additional feature of this invention is to provide a support guard preventing sideways sliding motion by flat bottomed vessels.

Another feature of this invention consists of a support stand having a base that is adapted to fit in a burner well and a top adapted to receive spheroid, rounded pots or pans. The base is shaped to fit snugly, and thus be seated securely in the well. The top is in the form of a ring, or in the form of inwardly slanting probes, that contact the pot or pan along a circular path of a spheroid, rounded bottom.

Another feature of this invention is a modification of an existing, prior art drip pan. The added feature forms an outer lip along the perimeter of the outside of the burner element that extends upward above the surface of the range top. The resulting extension supports rounded pots and pans. The combination serves the dual function of a drip pan and a support stand for round-bottomed cooking utensils. supporting a round bottomed vessel on a flat table top and for providing insulation to protect the table top. A further feature of this invention is the modification of an existing, prior art wok stand, or wok-ring, into an insulated wok-trivet permitting the trivet and wok to rest directly on a dining room table.

OBJECTS OF THE INVENTION

It is therefore a principal object of the present invention to provide improved means for securely supporting round-bottomed cooking utensils on top of gas or electric cooking ranges.

It is a further object of this invention to prevent sliding of pots and pans placed on top of a cooking range.

It is a further object of this invention to provide attachments that prevent sliding of cooking utensils.

It is a further object of this invention to modify prior art drip pans to also serve as support stands for cooking utensils.

It is a further object of this invention to provide a non-sliding stand for an Asian WOK cooking utensil.

It is a further object of this invention to provide an insulating stand to support a hot wok on a dining room table.

BRIEF DESCRIPTION OF THE DRAWINGS

The aforementioned objects and advantages of the present invention, as well as additional objects and advantages thereof, will be more fully understood hereinafter as a result of a detailed description of the invention when taken in conjunction with the accompanying drawings in which.

DETAILED DESCRIPTION OF PREFERRED EMBODIMENTS

Figure 1:
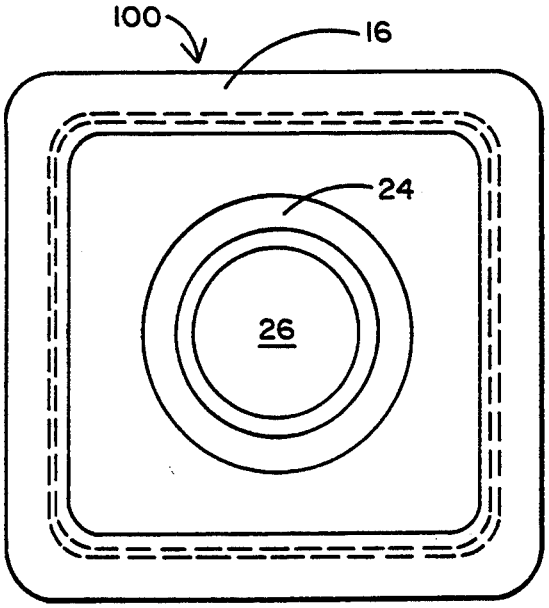
FIG. 1 PRIOR ART
FIG. 1 is a top view of a drip pan and burner of a gas range representing prior art.
Figure 2:
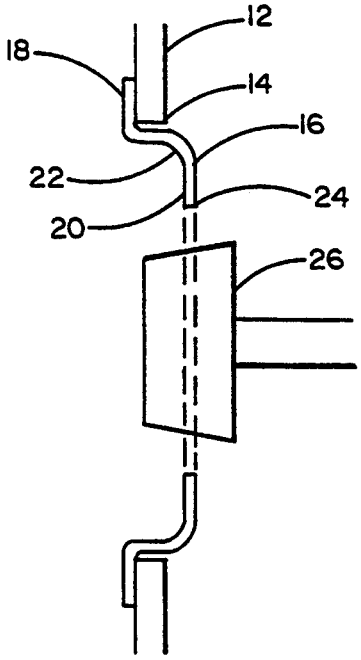
FIG. 2 PRIOR ART
FIG. 2 is a side view of the drip pan depicted in FIG. 1.

An example of a prior art design of a burner assembly 100 for a gas kitchen range is shown in FIGS. 1 and 2 of the drawings. A range top 12, having range top holes 14, receives a drip pan 16. The outside perimeter of the drip pan 16 has a flange 18 overlapping the range top hole 14. The flange 18 thus supports the drip pan 16 on the range top 12. The inner part of the drip pan 16 is recessed into a well 20 adapted to fit into the range top hole 14. The boundary between the flange 18 and the well 20 forms a concave perimeter ledge 22. The well 20 has a centered burner hole 24 for admitting a gas burner 26 therethrough. A flat topped rack (not shown) for flat bottomed pots and pans generally fits against the perimeter ledge 22. The rack extends above the range top 12 for supporting flat bottomed pots and pans above the gas burner 26.

Figure 3:
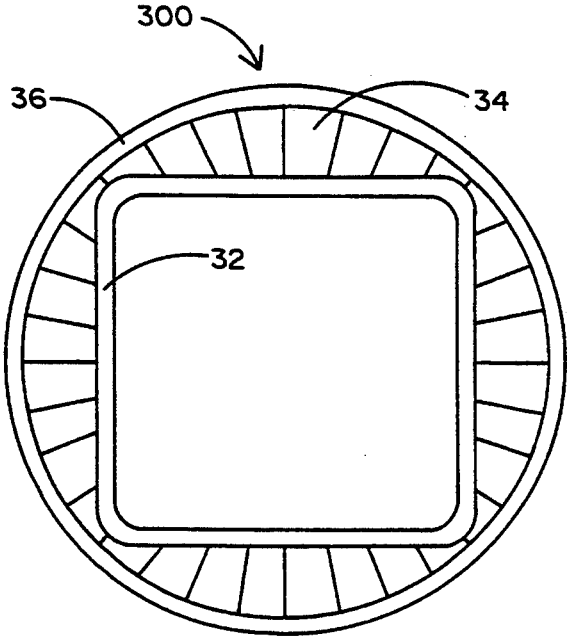
FIG. 3 is a top view of a support stand representing a first embodiment of this invention applied to a gas range.
Figure 4:
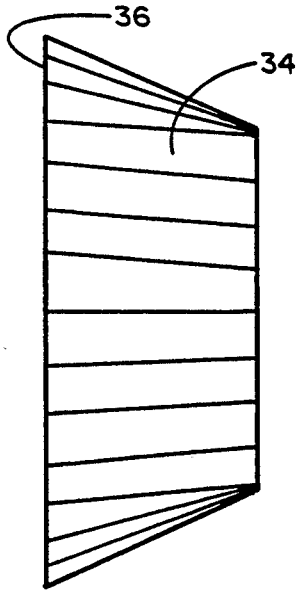
FIG. 4 is a side view of the embodiment depicted in FIG. 3.

A gas WOK stand 300 is shown in FIG. 3 and in FIG. 4. This stand represents a first embodiment of the invention for use in gas kitchen ranges. The WOK stand 300 has a generally square base 32 adapted to conform to the perimeter ledge 22 in well 20 of drip pan 16 as shown in FIG. 1 and FIG. 2. A WOK ring 36 is supported by a spacer 34. The ring 36 is adapted to receive a round-bottomed WOK, the diameter of the ring is thus sufficient to support the WOK in a stable manner. The spacer 34 is of sufficient height to hold the WOK a proper distance above the gas burner 26.

The base 32 and the WOK ring 36 of the WOK stand 300 are generally made from metal wire heavy enough to support the WOK. The spacer 34 is preferably made of sheet metal of sufficient thickness to support the WOK. The spacer 34 may have holes in the sides adapted to permit ventilation sufficient to ensure proper operation of the gas burner 26. Similarly, the spacer 34 may also be made from wire mesh. The mesh should have dimensions permitting ventilation for adequate gas burner operation while at the same time trapping hot air for hotter and more even heat distribution. The inside of the spacer 34 may also be coated with heat reflecting material to reflect heat into the WOK and thus obtain more efficient energy utilization.

Figure 5:
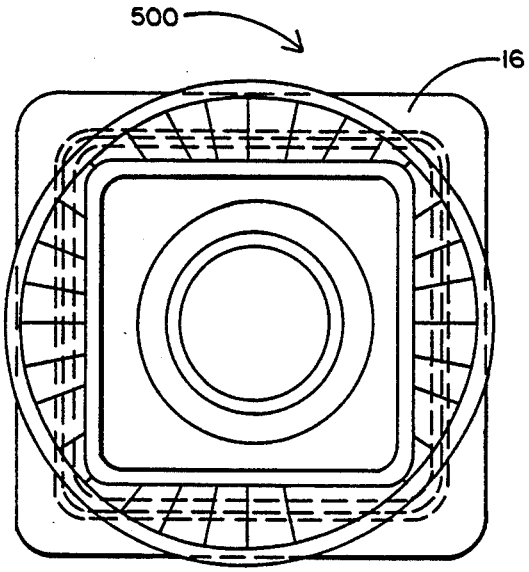
FIG. 5 is a top view of the first embodiment of FIG. 3 seated in the drip pan shown in FIG. 1.
Figure 6:
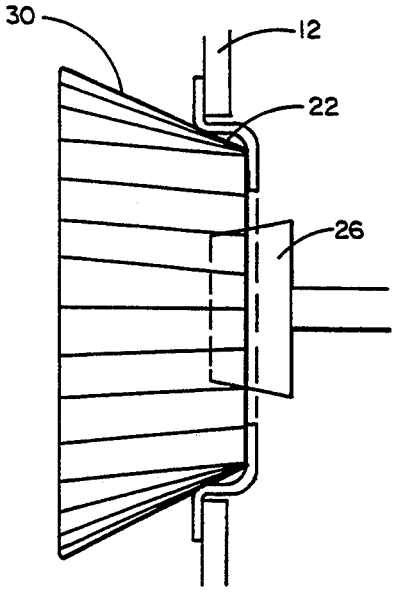
FIG. 6 is a side view of the first embodiment seated in the drip pan as depicted in FIG. 5.

In operation the WOK stand 300 is placed inside the drip pan 16 with the base 32 abutting the perimeter ledge 22. This placement anchors the stand, and consequently the WOK, to the range top. This thus provides a stable work space for a chef. FIG. 5 and FIG. 6 show the stand in place thus forming a WOK assembly 500.

Figure 7:
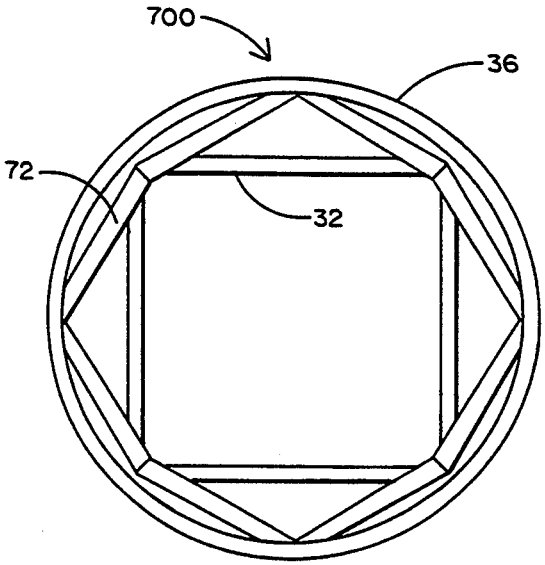
FIG. 7 is a top view of a second embodiment of this invention applied to a gas range and comprising a structure of wire-formed geometric polygons.
Figure 8:
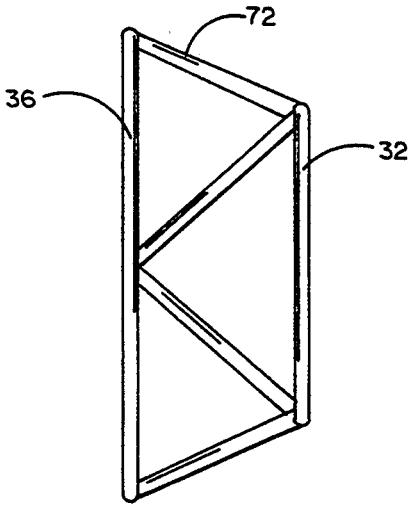
FIG. 8 is a side view of the embodiment depicted in FIG. 7.

A strut WOK stand 700 represents a second embodiment of a WOK stand for a gas range and is shown in FIGS. 7 and 8. The base 32 is square and the top support is a WOK ring 36 as in WOK stand 300 shown in FIG. 3 and FIG. 4. The connecting wall, however, is made up of wall struts 72 bridging the base and the ring. The struts 72 are fastened to the corners of the square base 32 and to the WOK ring 36 substantially halfway between the base corners. The struts therefore form a series of triangles providing rigidity for the support function as well as ventilation for gas burner operation. The stand is in all other respects like the gas WOK stand 300 of FIG. 3.

Figure 9:
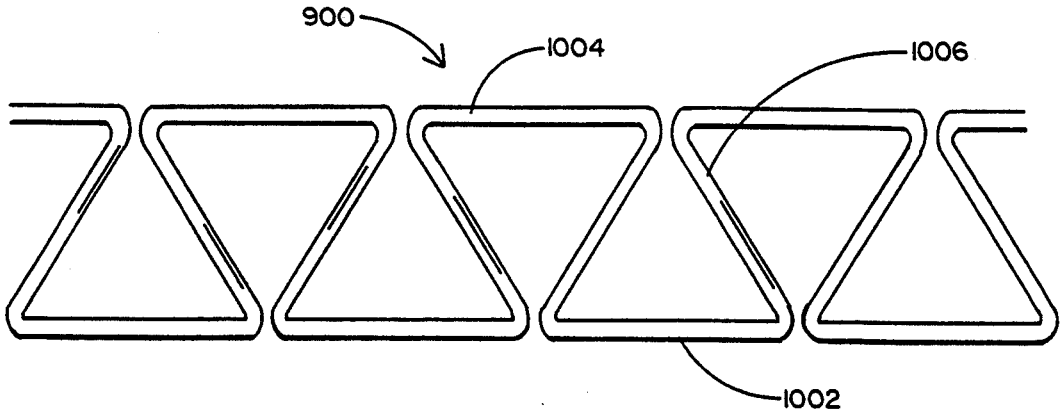
FIG. 9 is a side view of a wire-formed surface of geometric polygons.
Figure 10:
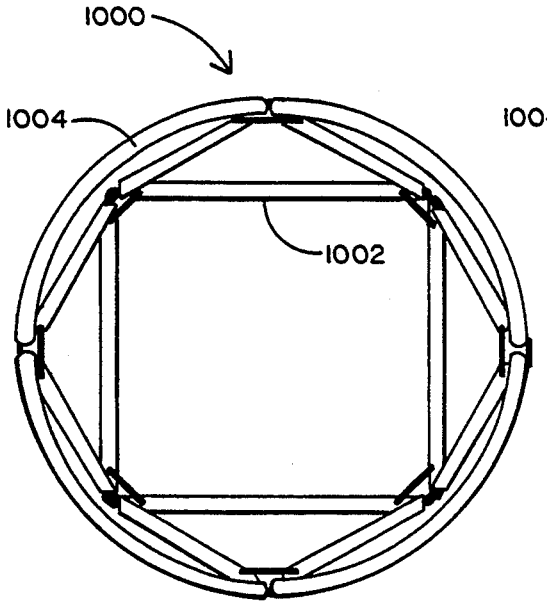
FIG. 10 is a top view of a third embodiment of this invention applied to a gas range and using the geometric surface of FIG. 9.
Figure 11:
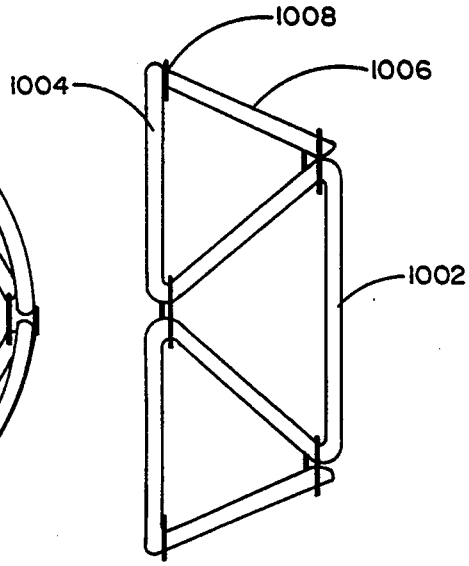
FIG. 11 is a side view of the embodiment depicted in FIG. 10.

FIGS. 9 through 11 show elements of a geometric stand 1000, a third embodiment of a WOK stand for a gas range. This stand is made from a geometric surface 900 consisting of a series of polygons formed by a single, continuous wire. FIG. 9 shows such a surface constructed from a single length of wire. The surface is formed by four basic isosceles triangles with bottom triangle bases 1002 at the bottom of FIG. 9. There are four inverted isosceles triangles having top triangle bases 1004 at the top of the drawing of FIG. 9. The bottom triangle bases 1002 of the four basic triangles have the dimensions of the perimeter ledge 22 of FIG. 1 and FIG. 2; the top triangle bases 1004 of the inverted triangles have the dimensions of one quarter of the circumference of the WOK ring 36 of FIG. 3. The triangle sides 1006 have dimensions assuring proper distance of the WOK above the gas burners 26.

The surface 900 is folded back on itself to form substantially a circle. The bottom triangle bases 1002 remain straight; therefore, this side of the surface 900 forms a square adapted to fit against the perimeter ledges 22 of the drip pan 16. The top triangle bases 1004 are bent to conform to the contour of a segment of a circle; therefore, this side of the surface 900 forms a circle adapted to support a WOK.

The assembled geometric stand 1000 is shown in FIG. 10 and FIG. 11. The overall structure is formed by joining the individual triangles at the triangle corner. Fastening may be achieved by many forms; welding is an example. However, it is preferable to use a set of loosely applied ties. The resulting structure is inexpensive to fabricate. It adapts to fit both the perimeter ledge 22 as well as the WOK. The triangles provide the necessary rigidity to support the system of WOK and stand.

The embodiments described above reflect kitchen gas ranges with square drip pans 16 conforming to square range top holes 14. However, the configurations of gas kitchen ranges comprise a plurality of different range top holes and drip pans; some are square, some are circular, and some are rectangular. There are also numerous different dimensions. However, the embodiments described above apply to each of these configurations. Thus, the bases of the WOK stands may be square, circular, or rectangular depending on range designs.

the enumerated embodiments rely on a drip pan as a foundation to support a stand. This is convenient since most kitchen ranges do have drip pans. However, this is not required; a stand may replace a drip pan, and may thus function as a combined drip pan and stand. Such a combined element would anchor to the range top or range top hole rather than to the independent drip pan. The combined stand is shown in an embodiment described below.

Figure 12:
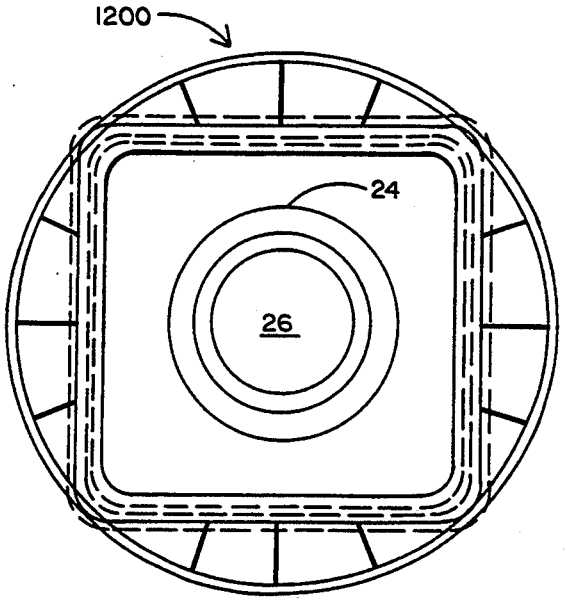
FIG. 12 is a top view of a fourth embodiment of this invention applied to a gas range and comprising a combination drip pan and stand applied to a gas range.
Figure 13:
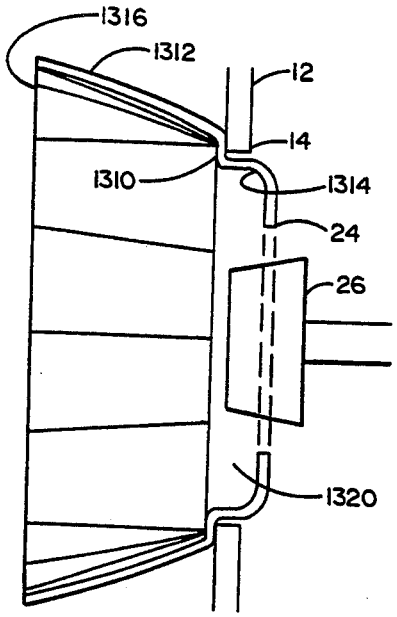
FIG. 13 is a side view of the embodiment depicted in FIG. 12.

An embodiment constituting a combined stand 1200 is shown in FIG. 12 and FIG. 13. The stand represents a fourth embodiment of this invention applied to a gas range with a gas burner assembly 100. The planar view in FIG. 12 shows the combined stand 1200 inserted in the range top. A burner hole 24 accommodates the gas burner 26 in a manner similar to that of the drip pan of the prior art shown in FIG. 1 and FIG. 2. The side view in FIG. 13 shows particularly how the combined stand combines the standard gas range drip pan according to prior art and a WOK stand according to this invention.

The side view of the combined stand 1200 in FIG. 13 shows the stand set into the range top hole 14 of the range top 12. The outside perimeter of the combined stand 1200 has a flange 1310 overlapping the range top hole 14 thus supporting the combined stand 1200 on the range top 12. The inner part of the combined stand 1200 is recessed into a well 1320 adapted to fit into the range top hole 14. Gas burner hole 26 is located in the center of the well 1320.

The outer boundary of the flange 1310 is curved upward to form a cone-shaped combined cap 1312. The cap 1312 terminates in combined rim 1316 which has a diameter adapted to receive a round-bottomed WOK. The height of the combined cap 1312 and the diameter of the combination rim 1316 are adapted to maintain the WOK a preferred distance above the gas burner 26. The diameter of the combination rim is also adapted to provide stable seating for the WOK.

The combined stand is installed in the same manner as a prior art drip pan. The prior art drip pan 16 is removed and simply replaced with the combined stand 1200. The placement of the well 1320 in the range top hole 14 anchors the combined stand 1200 to the range top. This provides a stable work stand for the WOK. The WOK is placed upon the stand and seated in the combined rim 1316 to be stable and to remain a preferred distance above the gas burner 26.

Figure 24:
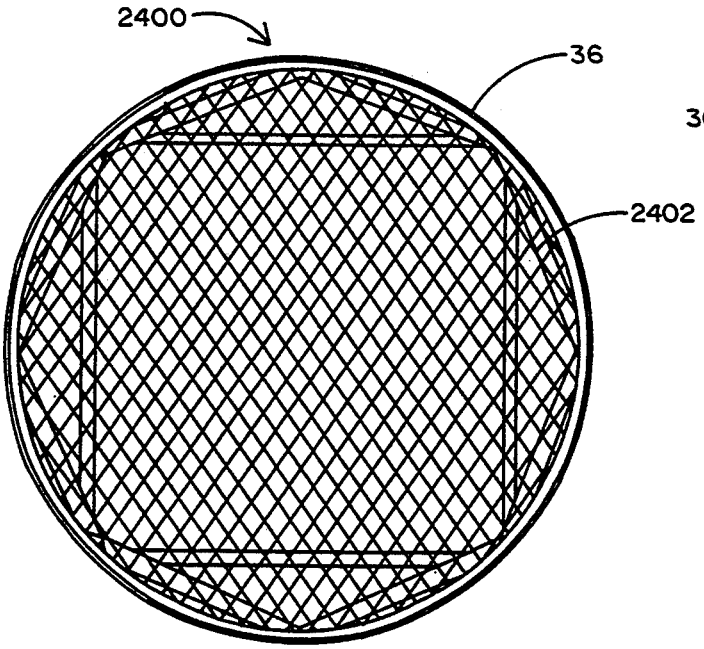
FIG. 24 is a top view of a double bottom support stand representing a fifth embodiment of this invention applicable to a gas range.
Figure 25:
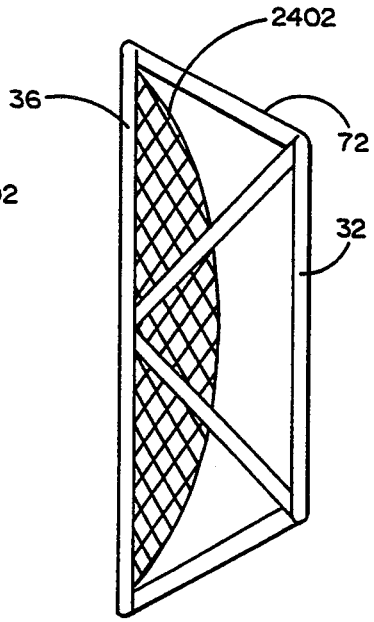
FIG. 25 is a side view of the system depicted in FIG. 24.

A double bottom stand 2400 represents a fifth embodiment of the invention applicable to a gas range. The embodiment is shown in FIGS. 24 and 25.

This embodiment builds on the strut WOK stand 700. Fastened to the WOK ring 36 is a spheroid metal wire mesh base 2402. The top of the mesh base 2402 forms a circle corresponding to the WOK ring 36. The body of the mesh base 2402 is shaped to form a spheroid below the plane of the WOK ring 36 that is adapted to conform to the rounded bottom of the WOK. In other respects the stand is like the strut WOK stand 700.

In operation the WOK is placed on the WOK ring 36. In this position, the WOK bottom rests close to or substantially against the mesh base 2402. The wall struts 72 provide un-impeded flow of air to the gas heater element thus insuring adequate combustion of gas fuel. The mesh base 2402, WOK bottom, and WOK ring 36 form an enclosed cavity that traps hot air and gases. The trapped air receives heat both from secondary heating of the mesh as well as from hot air flowing through the mesh. This results in hotter and more event distribution of heat to service the WOK.

The closeness of the mesh openings need not service the gas heater combustion and may therefore be substantially finer. The fineness is adapted to provided sufficient density to form the abovementioned cavity. At the same time a fine open mesh provides enough flow-through of hot air from the gas flame to provide circulation of the hot air to replace heat lost in transfer to the WOK bottom.

Figure 14:
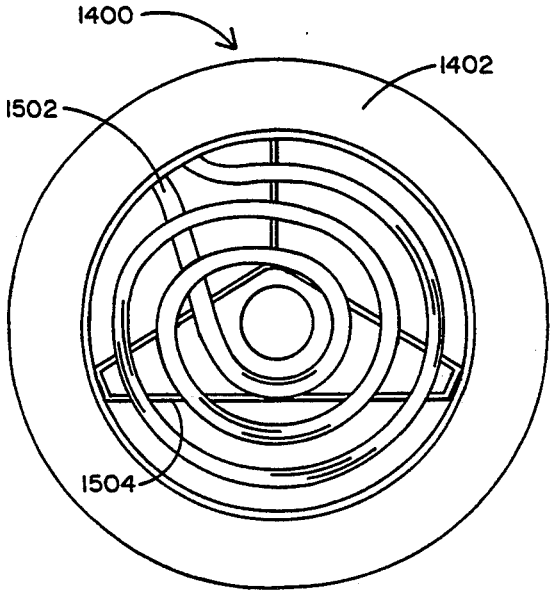
FIG. 14 PRIOR ART
FIG. 14 is a top view of a standard drip pan and heating coils corresponding to prior art design of an electrical range.
Figure 15:
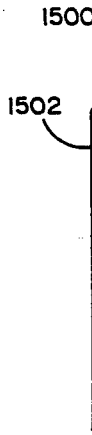
FIG. 15 PRIOR ART
FIG. 15 is a side view of the electrical heating coil element of the system depicted in FIG. 14.
Figure 16:
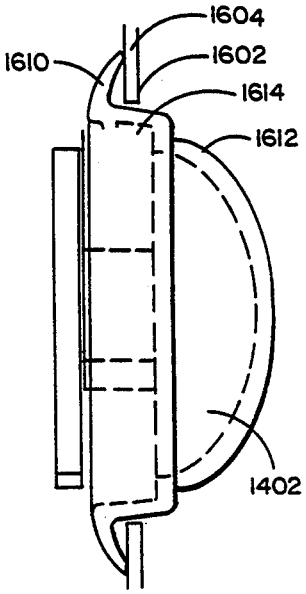
FIG. 16 PRIOR ART
FIG. 16 is a side view of the system depicted in FIG. 14.

An electric assembly 1400 for an electric kitchen range is shown in FIGS. 14 through 16 of the drawings as an example of a prior art design. In FIG. 14 is shown a top view of the electric assembly 1400, in FIG. 15 is shown a side view of a heating coil assembly 1500, and in FIG. 16 is shown a side view of the electric assembly 1400 disposed in a range top hole 1602.

As shown in FIG. 14 electric assembly 1400 comprises the heating coil assembly 1500 set in a drip pan 1402. The heating coil assembly 1500 comprises spiral heating coil 1502 mounted substantially horizontally on mounting spacer 1504 as is shown in the side view of FIG. 15. The heating coils terminate in an electrical connector (not shown) permitting easy removal and reinstallation of the coil. Mounting spacer 1504 is substantially star-shaped in the horizontal plane and adapted to fit inside the drip pan 1402.

In FIG. 16 is shown the electric assembly 1400 and particularly the range top hole 1602 in range top 1604. The outside perimeter of the drip pan 1402 has a flange 1610 overlapping the range top hole 1602. The flange thus supports the drip pan 1402 on the range top 1604. The inner part of the drip pan 1402 is recessed into a well 1612 adapted to fit into the range top hole 1602. The boundary between the flange 1610 and the well 1612 forms a circular, concave perimeter ledge 1614. The perimeter ledge 1614 is adapted to receive the mounting spacer 1504 and thus the electric assembly 1400. An access hole (not shown) is placed in the well 1612 to provide access for electrical connection of the heating coil 1502.

Figure 17:
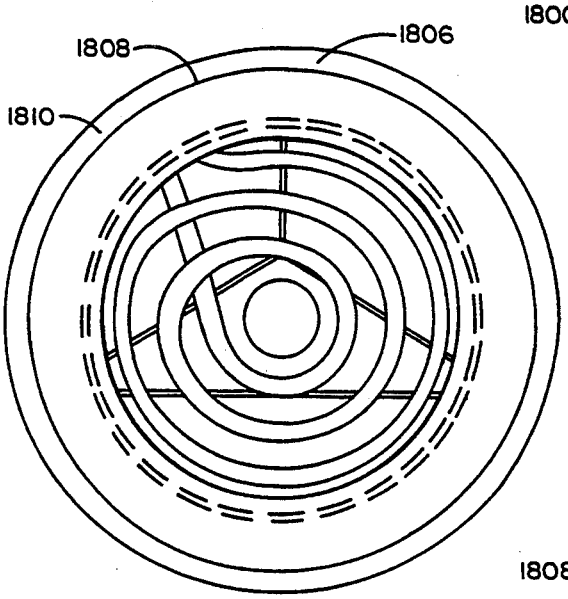
FIG. 17 is a top view of a support stand representing a first embodiment of this invention applied to an electric range.
Figure 18:
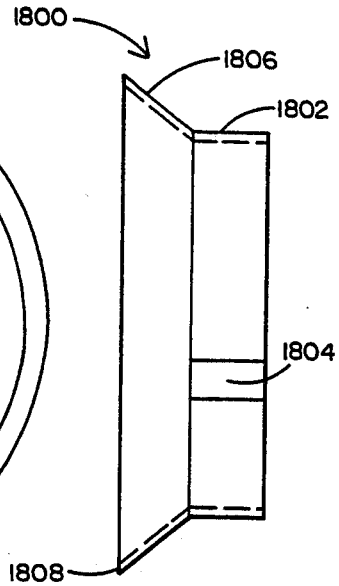
FIG. 18 is a side view of the support stand depicted in FIG. 17.
Figure 19:
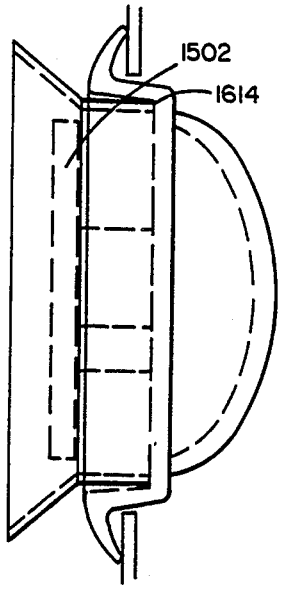
FIG. 19 is a side view of the embodiment depicted in FIG. 17.

An electric WOK stand 1800 shown in FIG. 17, FIG. 18 and FIG. 19 represents a first embodiment of this invention adapted to fit an electric kitchen range. The electric WOK stand 1800 is an adaption to an existing, prior art electric assembly 1400 described above. As shown in FIG. 18, a hollow electric base 1802 has a base perimeter adapted to fit on the perimeter ledge 1614 inside the drip pan 1402. The base material is thin enough to fit between the perimeter ledge 1614 and the heating coil 1502. The electric base 1802 has cut-outs 1804 adapted to fit over that part of the star-shaped mounting spacer 1504 resting on the perimeter ledge 1614.

Disposed on top of electric base 1802 is cone-shaped cap 1806. The cap 1806 terminates in substantially circular rim 1808 which has a diameter adapted to receive a round-bottomed WOK. The height of the cap 1806 and the diameter of the rim 1808 are adapted to maintain the WOK a preferred distance above the heating coil 1502.

In operation, the electric WOK stand 1800 is placed in the drip pan 1402 as outlined above. The placement of the hollow base abutting the perimeter ledge 1614 anchors the WOK stand 1800 to the range top. It thus provides a stable work stand for the WOK. The WOK is placed upon the stand and seated in the rim 1808 to be stable and to remain a preferred distance above the heating coil 1502.

Figure 20:
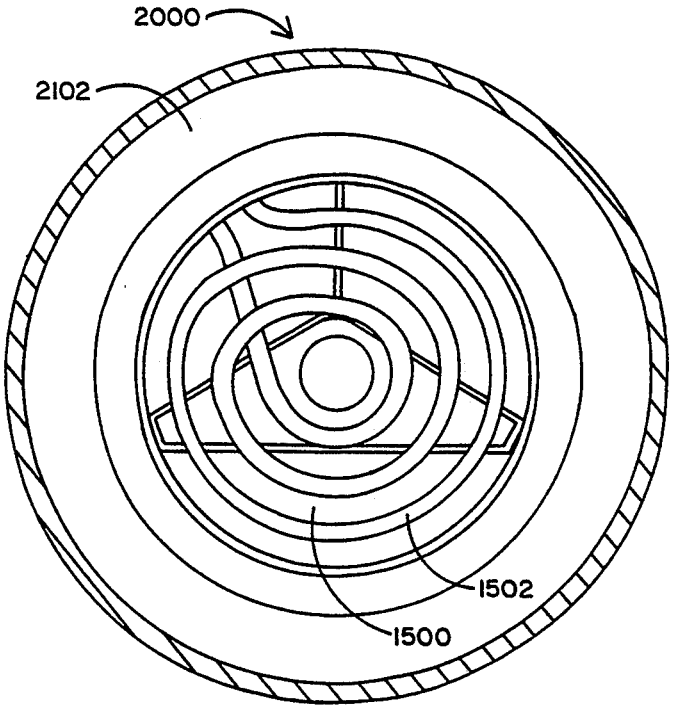
FIG. 20 is a top view of a combination drip pan and stand representing a second embodiment of this invention applied to an electric range.
Figure 21:
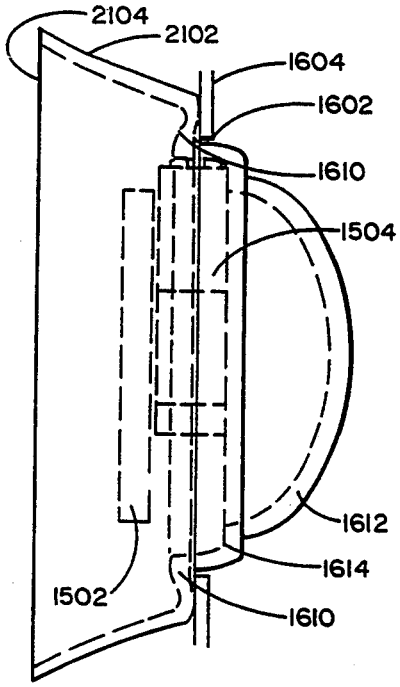
FIG. 21 is a side view of the embodiment depicted in FIG. 20.

An electric combination stand 2000 is shown in FIG. 20 and FIG. 21. The stand represents a second embodiment of this invention applied to an electric range with an electric heating coil assembly 1500. The combination stand 2000 is shown in a planar view in FIG. 20 and in a side view in FIG. 21. The planar view in FIG. 20 shows the electric heating coil assembly 1500 inserted in a combination stand 2000. The side view in FIG. 21 shows in particular how the stand combines, both functionally and structurally, the standard, prior art electric drip pan and a WOK stand.

The side view of the combination stand 2000 in FIG. 21 shows the stand set into the range top hole 1602 in range top 1604. The outside perimeter of the combination stand 2000 has a flange 1610 overlapping the range top hole 1602 thus supporting the combination stand 2000 on the range top 1604. The inner part of the combination stand 2000 is recessed into a well 1612 adapted to fit into the range top hole 1602. The boundary between the flange 1610 and the well 1612 forms a concave perimeter ledge 1614. The perimeter ledge 1614 is adapted to receive the mounting spacer 1504 and thus the electric assembly 1400.

The outer boundary of the flange 1610 is curved to form a cone-shaped combination cap 2102. The cap 2102 terminates in combination rim 2104 which has a diameter adapted to receive a round-bottomed WOK. The height of the combination cap 2102 and the diameter of the combination rim 2104 are adapted to maintain the WOK a preferred distance above the heating coil 1502.

The combination stand is installed in the same manner as a prior art drip pan. The heating coil assembly 1500 is removed by un-connecting the heating coil 1502. The combination stand 2000 is next installed into the range top hole 1602 in the same manner as is the prior art drip pan. The heating coil assembly 1500 is lastly re-installed by re-connecting the heating coil.

In operation, the combination stand 2000 is emplaced as outlined above. The placement of the well 1612 in the range top hole 1602 anchors the combination stand 2000 to the range top and provides a stable work stand for the WOK. The WOK is placed upon the stand and seated in the rim 2104 to be stable and to remain a preferred distance above the heating coil 1502.

Figure 22:
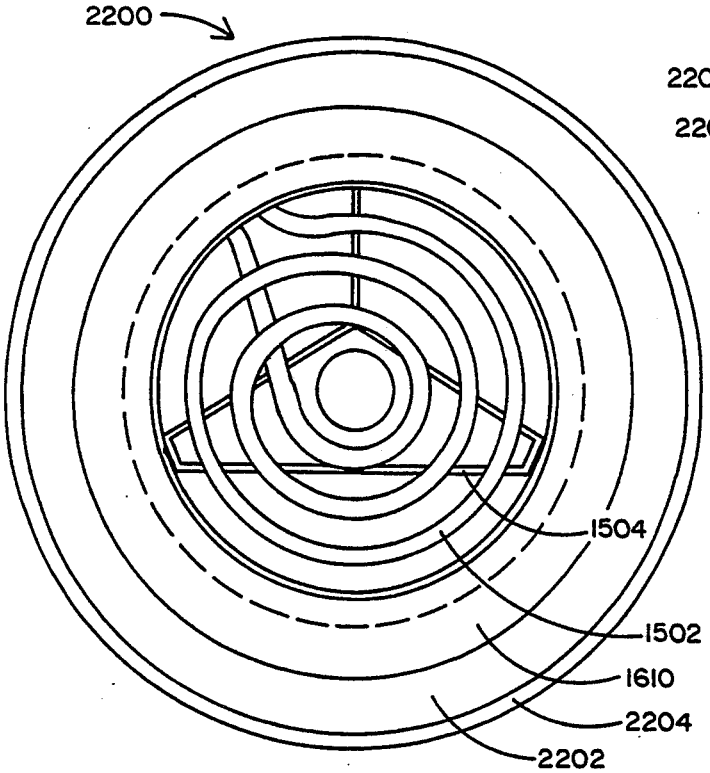
FIG. 22 is a top view of a simple support stand representing a third embodiment of this invention applied to electric ranges.

A simple electric stand 2200 represents a third embodiment of this invention as applied to an electric range. This embodiment operates in cooperation with an existing drip pan. After first removing the drip pan, the simple stand 2200 is placed directly on top of the range top. It is then anchored to the kitchen range by reinserting a drip pan 1600. The stand 2200 is shown installed on a kitchen range in a planar view in FIG. 22 and in a side view in FIG. 23.

Figure 23:
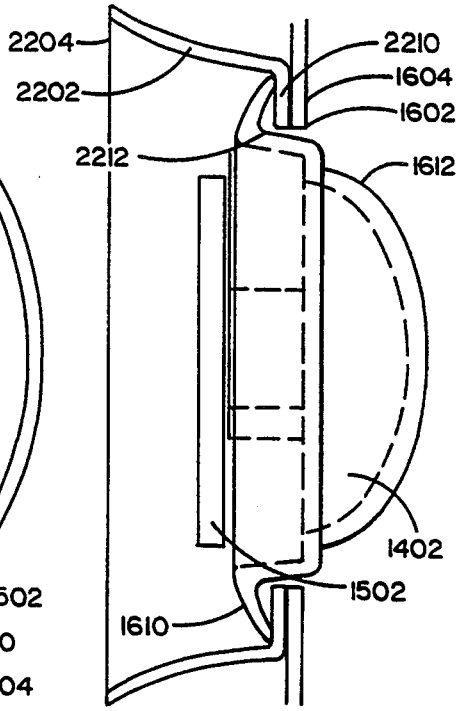
FIG. 23 is a side view of the system depicted in FIG. 22.

The side view of FIG. 23 show construction details and illustrate the integration with the electric burner assembly. The simple stand 2200 is formed generally as a cylinder. A cylindrical wall 2200 reaches up to a circular top rim 2204 providing support for a WOK. The wall rests on a flange base 2210 that is formed by an inward-turning flange. The inner diameter of the flange base 2210 forms a base hole 2212 which has substantially the same diameter as the range top hole 1602.

In operation the electrical drip pan 1600 and the heating coil assembly 1500 are first removed from the electrical range top. The simple stand 2200 is then placed on top of the range top 1604 and over and concentric to the range top hole 1602. The electrical drip pan 1600 is next placed inside the cylindrical wall 2202. In this position the flange 1610 of the drip pan 1600 now rests on top of the flange base 2210. The drip pan 1600 now anchors the simple stand 2200 to the range top 1604 in a vertical direction. Furthermore, in this position, the drip pan well 1612 extends through both the base hole 2212 of the simple stand 2200 as well as the range top hole 1602 of the range top 1604. This action locks the simple stand 2200 to the range top 1604 in a horizontal direction.

In operation the simple stand 2200 is thus effectively anchored to the range top and as is a WOK placed on the stand.

Both electric combination stand 2000 and simple stand 2200 are shown with solid side walls. These solid walls, the drip pan, and the WOK bottom form a cavity containing the electric heater coil. Heat from the heater coil reflects generally both from the drip pan as well as the walls. The enclosed cavity also traps hot air as well as prevents external air to cool the area. The combination produces a more efficient system which increases the available heat normally provided by an electric burner in a ventilated system.

The description above has dealt with gas and electric ranges and consequently gas and electric heating elements. Other configurations are equally applicable; propane gas stoves with their heating elements are examples. Nor is the system limited to heating ranges or ovens. Thus, this invention also includes a trivet embodiment, a support of a wok on a flat table.

A first element of a general trivet for a round bottom vessel is a simple hollow stand with upper at least three support points lying on a circle, thus adapted to receive the round bottom vessel. The second element, which converts the simple stand into a trivet, is plain insulating means deposed on the bottom of the stand.

Figure 26:
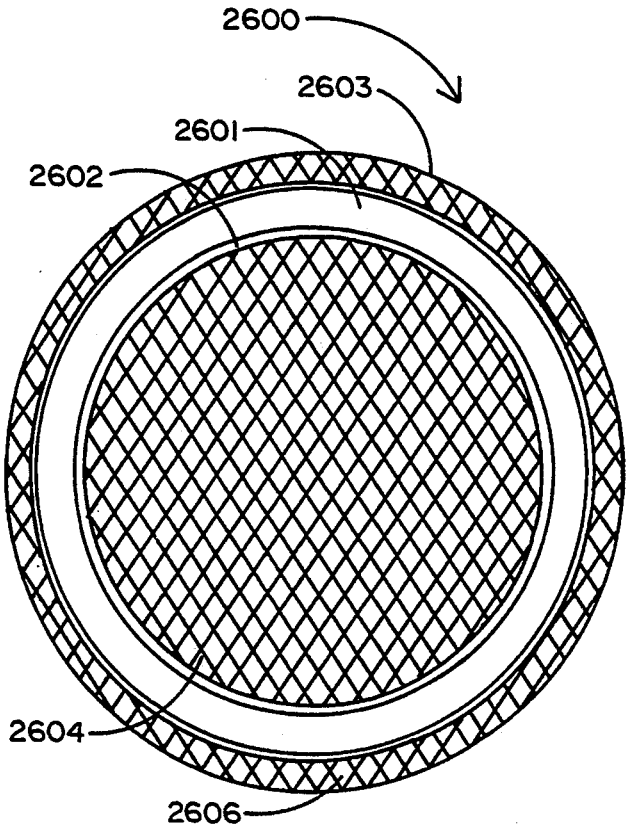
FIG. 26 is a top view of an insulating stand for a wok.
Figure 27:
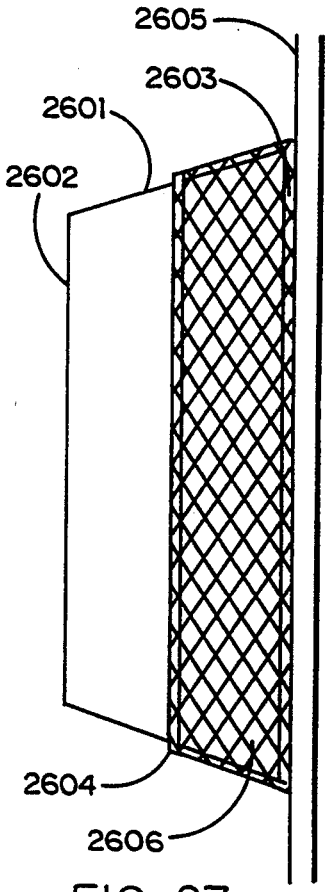
FIG. 27 is a side view of the system depicted in FIG. 26.

A fabric-covered wok trivet 2600 is shown in FIG. 26 and FIG. 27 and represents a first specific embodiment of this invention. In this embodiment a standard, prior art wok ring is converted into a wok trivet serving to insulate and protect a table from heat in a hot wok and scratches caused by rough material in the stand itself. In this specific embodiment fabric insulation is emplaced by stretching a section of fabric over the bottom of the wok ring.

In FIG. 26 and FIG. 27 a cylindrical sidewall 2601 terminates in a top ring 2602 and a bottom ring 2603. The radius of the top ring 2602 is adapted to receive a round bottom wok and is generally smaller than the radius of the bottom ring 2603. The sidewall 2601 therefore slopes inward from the bottom of the trivet.

A base fabric 2604 is substantially circular with a diameter generally larger than the diameter of the bottom ring 2603. The larger diameter of the base fabric 2604 forms an excess fabric area 2606 extending outside the bottom ring 2603. An elastic band 2607 is embedded along the outer circumference of the excess fabric area 2606.

In operation, the base fabric 2604 is stretched across the bottom ring 2603. The excess fabric area 2606 wraps around the bottom ring 2603 and extends partially up the sidewall 2601. A portion of the fabric thus lies between the bottom ring 2603 and the table top 2605 and thus serves as an insulating agent protecting the table top 2605. The elastic band 2607 contracts about the sloping sidewall 2601 therefore exerts a force upward, thereby keeps the base fabric 2604 in place.

The preferred embodiment described above lays down an insulating layer on the bottom ring of the stand by wrapping fabric around the entire bottom of the stand.

In this embodiment an existing wok ring is the foundation for a trivet. An insulating material is deposed on the bottom by stretching a fabric over the ring. However, a number of alternative ways may be used to form an insulating layer on the bottom of a stand. Thus any stand lending itself to support of a round bottom wok may be used as a base. Likewise, a number of insulating material may be attached to a bottom rim of the stand and fastened in a number of ways. For example, insulating material may be deposited directly on the rim with glue or other adhesives. Similarly, a tube, made of insulating material and slit along its entire side, may be pressed onto a bottom rim.

It will now be understood that the present invention comprises new and novel ways of supporting an Asian WOK on a kitchen range as well as on any general flat surface.

Various novel embodiments have been disclosed that are exemplary of this invention and demonstrate a wide range of applications that have not been shown in prior art. Those having ordinary skill in the art will now perceive, as a result of the applicant's teaching herein, modifications and additions to the invention described herein. By way of example, there are numerous alternative stand structures which will receive a WOK and anchor the stand to the range top structure. There are also numerous containers that may be adapted to the use of the stand of this invention. Thus, any round-bottomed vessel is applicable. Therefore, all such modifications and additions are deemed to be within the scope of the invention which is limited only by the claims appended hereto.

I claim:

1. A support assembly providing for secure placement of a round-bottomed cooking vessel on an electric kitchen range, the assembly comprising:

a range top having a heater opening;

a support stand placed on the range top substantially over the heater opening, the stand having a base with a base center hole substantially equal to the heater opening, the stand having a base flange extending horizontally outward from the base center hole to a base perimeter, the stand further having a substantially upright outer side substantially at the base perimeter and adapted to receive the round-bottomed cooking vessel;

a drip pan having a recessed well extending into the heater opening and a horizontal outer flange extending out over the range top, the recessed well forming a substantially vertical recessed wall inside the outer flange extending through both the base center hole and the heater opening; and an electric heater assembly adapted to seat in the drip pan;

whereby, upon sequential placement of first the stand on the range top over the heater openings, next the drip pan inside the stand with the recessed wall extending through both the base center hole and the heater opening and with the outer flange resting on the base flange, and finally the electric heater assembly in the drip pan, the weight of the combined drip pan and electric heater assembly acting against the base flange will hold the stand down against the range top while the recessed wall penetrating both the base center hole and the heater opening will lock the stand to the range top in a horizontal direction.

* * * * *